US006948628B1

(12) United States Patent
Sahlem

(10) Patent No.: US 6,948,628 B1
(45) Date of Patent: Sep. 27, 2005

(54) CLOTHES HANGER RETAINING DEVICE

(76) Inventor: Donald Peter Sahlem, 4635 N. Millgrove Rd., Akron, NY (US) 14001

( * ) Notice: Subject to any disclaimer, the term of this patent is extended or adjusted under 35 U.S.C. 154(b) by 38 days.

(21) Appl. No.: 10/621,672

(22) Filed: Jul. 17, 2003

(51) Int. Cl.[7] ..... A47H 13/00
(52) U.S. Cl. ..... 211/124; 211/105.1
(58) Field of Search ..... 211/124, 105.1, 211/123, 7, 105.2, 105.3, 105.4, 105.5, 105.6; 248/251, 214; D6/546

(56) References Cited

U.S. PATENT DOCUMENTS 2,595,702 A * 5/1952 Prevost ..... 239/513
2,980,260 A * 4/1961 Richer ..... 211/124
3,252,637 A * 5/1966 Hart ..... 224/275
3,298,503 A * 1/1967 Field et al. ..... 206/279
3,306,465 A * 2/1967 Brennan ..... 211/124
3,472,385 A * 10/1969 Vincent et al. ..... 211/7
4,037,728 A 7/1977 Cameron
4,105,268 A * 8/1978 Elias et al. ..... 312/184
4,139,102 A 2/1979 Winton
4,340,145 A 7/1982 Cameron
4,496,060 A * 1/1985 Anderson et al. ..... 211/124
4,723,665 A * 2/1988 Benedict et al. ..... 211/168
4,779,746 A * 10/1988 Usner ..... 211/124
4,887,727 A * 12/1989 Simmerman et al. ..... 211/124
5,121,844 A * 6/1992 Ball ..... 211/124
5,294,005 A * 3/1994 Hedges ..... 211/85.7
5,697,508 A * 12/1997 Rifkin et al. ..... 211/162
2002/0148797 A1 * 10/2002 Feder ..... 211/124

* cited by examiner

*Primary Examiner*—Jennifer E. Novosad

(57) ABSTRACT

A clothes hanger retaining device is described. The retaining device is comprised of an inverted trough shaped cover that is positioned over a clothes pole and clothes hangers and secured to the clothes pole by a strap moved about the clothes pole and then secured back to the cover.

3 Claims, 10 Drawing Sheets

CLOTHES HANGER RETAINING DEVICE

BACKGROUND OF THE INVENTION

1. Field of Invention

The present invention relates to devices for retaining clothes hangers on a clothes pole.

2. Prior Art

This invention relates generally to a clamping device used to secure clothes hangers to clothes poles thereby preventing the hangers from becoming dislodged during movement. Such movement is common in a recreational vehicle or commercial garment-shipping container.

Previously, the retention of clothes hangers on clothes poles has been accomplished as described in U.S. Pat. No. 4,340,145 and U.S. Pat. No. 4,139,102. The device described in U.S. Pat. No. 4,139,102 solved the problem of clothes hanger retention, however this prior art consisted of many component parts. The device described in U.S. Pat. No. 4,340,145 performed a similar function but was not adaptable to existing clothes poles.

3. Objects and Advantages

The objects and advantages of the present invention are:

(a) To provide a retaining device which has fewer components than the prior art.

(b) To provide a retaining device which is compatible with existing clothes poles and hangers.

(c) To provide a retaining device that is, in one embodiment, adjustable in length.

(d) To provide a retaining device which prevents the clothes hangers from lateral movement beyond the confines of the device.

Further objects and advantages of my invention will become apparent from a consideration of the drawings and ensuing description.

SUMMARY OF THE INVENTION

The present invention is directed to a convenient, easily installed retaining device to prevent clothes hangers from becoming dislodged from clothes poles during transit.

DETAILED DESCRIPTION

Figure 1:
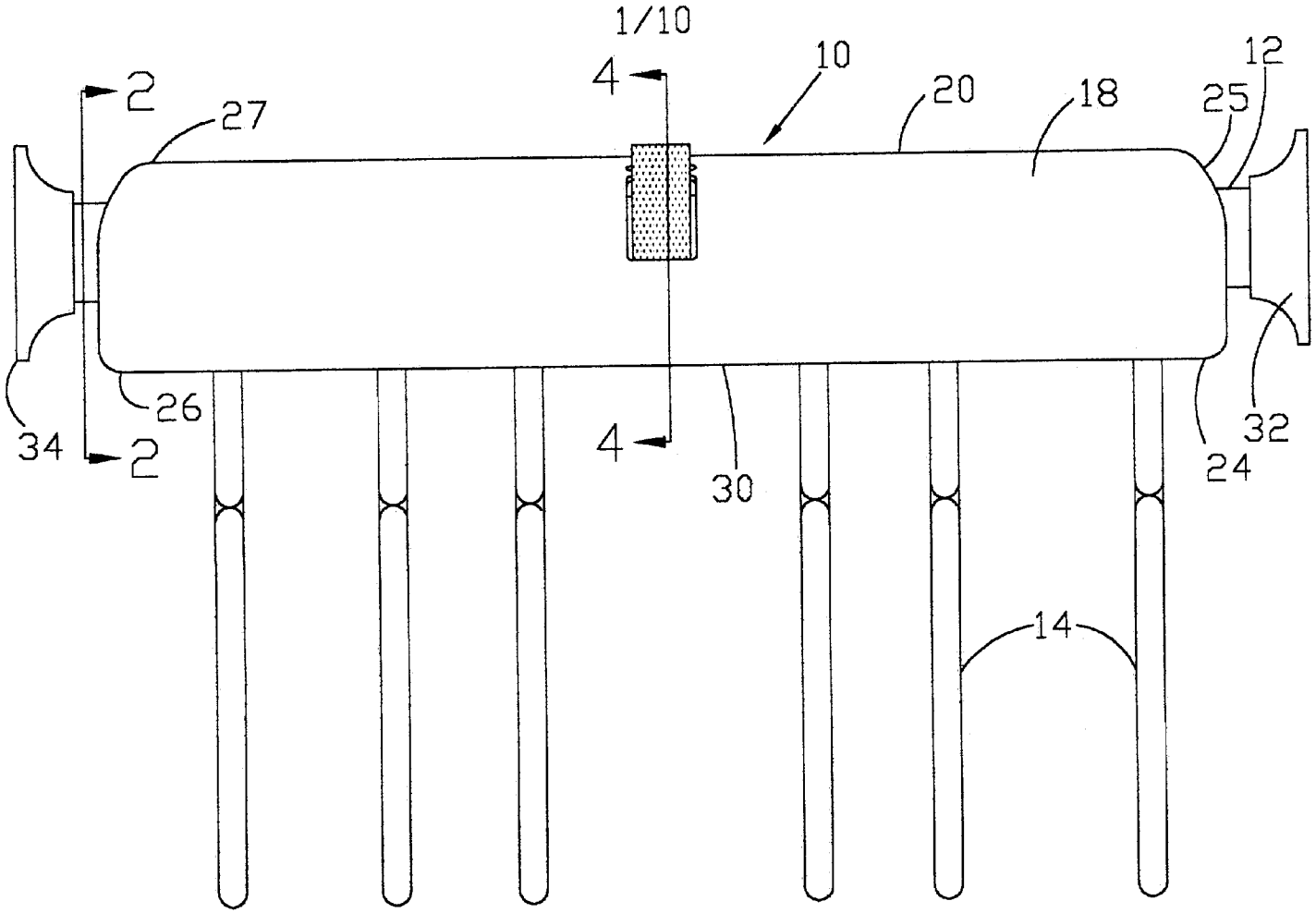
FIG. 1 is a front view of the clothes hanger retaining device, shown installed.

Turning now to the drawings, FIGS. 1 to 5 show a first embodiment of a clothes hanger retaining device 10 according to the present invention. The retaining device 10 is used in conjunction with a horizontal pole 12 supporting a plurality of clothes hangers 14 thereon. The clothes hangers 14 can have clothing articles such as pants, shirts, jackets and the like hung thereon or the clothes hangers can be empty. To prevent the clothes hangers 14 from falling off of the pole 12, the retaining device 10 is draped over the neck 16 of each of the clothes hangers 14. The neck 16 is the portion of the clothes hanger 14 adjacent to the pole 12. When the pole 12 is mounted in a motor home and the like, the uneven ride of the motor home traveling on a road can cause the coat hangers to fall off of the pole 12, however, the present retaining device 10, prevents this from happening.

Figure 2:
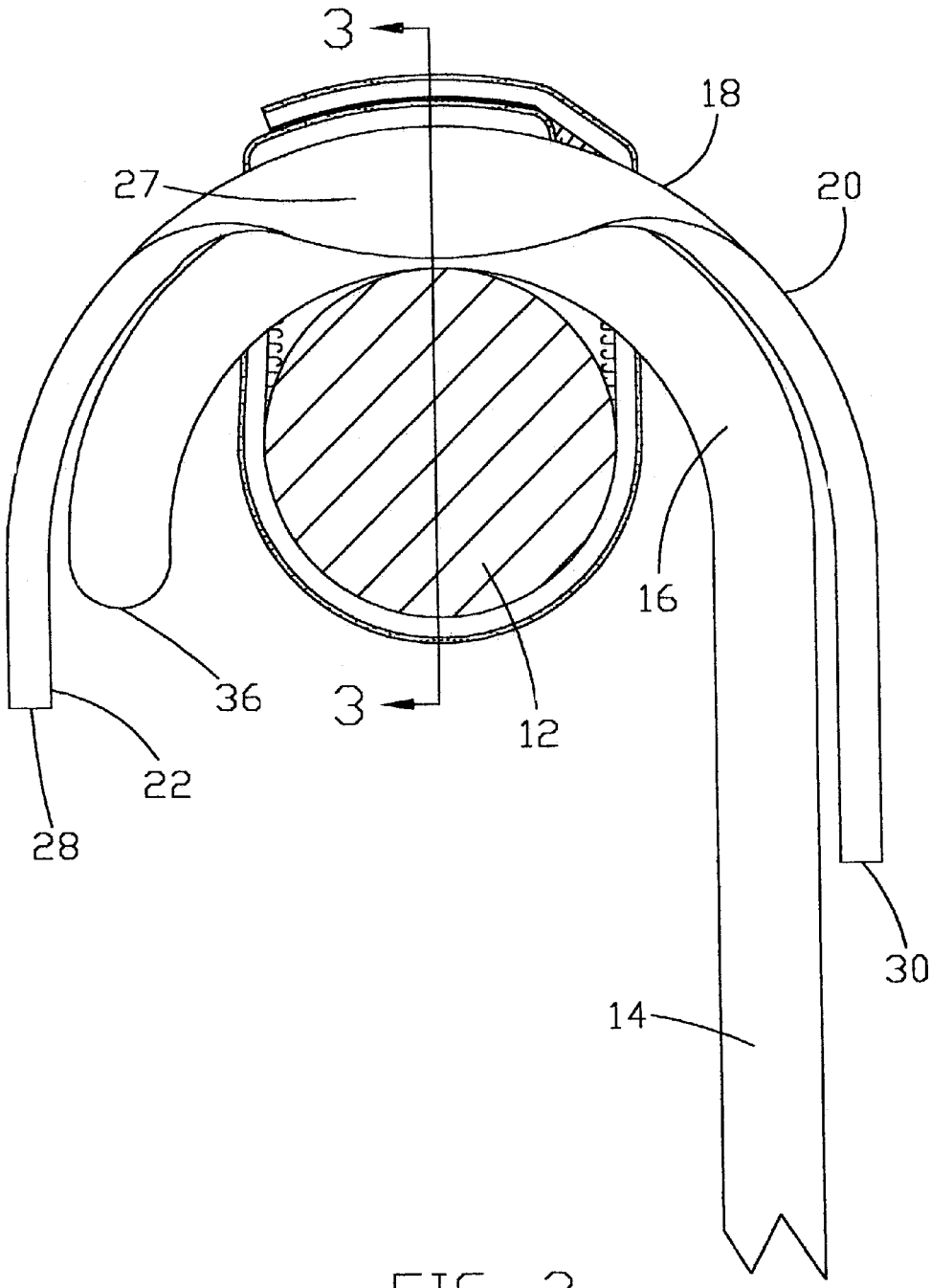
FIG. 2 is a left side view of the clothes hanger retaining device.
Figure 3:
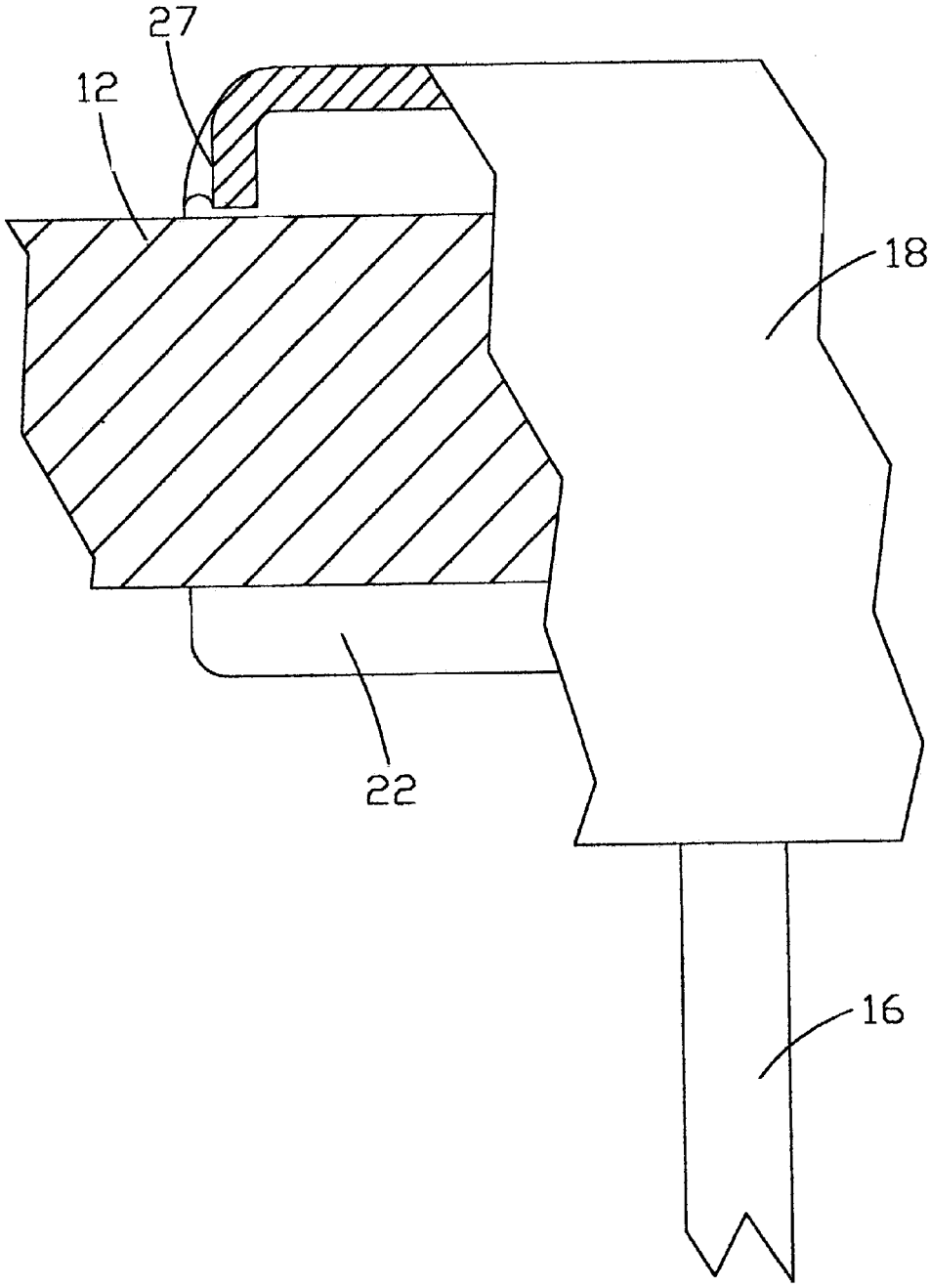
FIG. 3 is a sectional view of FIG. 2, depicting section 3—3.

The retaining device 10 comprises an elongate cover 18 having an upper side 20 and a lower side 22 extending to spaced apart first and second ends 24 and 26 and front and back edges 28 and 30. In addition, the first and second ends have downward facing flanges 25 and 27 (FIGS. 2 and 3). The cover 18 has a length sufficient to substantially blanket the pole 12 with the first end 24 residing adjacent to a first pole support 32 and a second end 26 residing adjacent to a second pole support 34. While not shown in the drawings, the pole supports 32 and 34 are extended to the inside walls of a closet and fastened thereon.

As shown in FIG. 2, the cover 18 blankets the neck portion 16 of the coat hangers 14 with the front edge 28 adjacent to the terminus 36 of the hanger neck 16 and the back edge positioned adjacent to where the neck 16 of the hanger 14 attaches to the shoulder portion (not shown) supporting the clothes (not shown).

Figure 4:
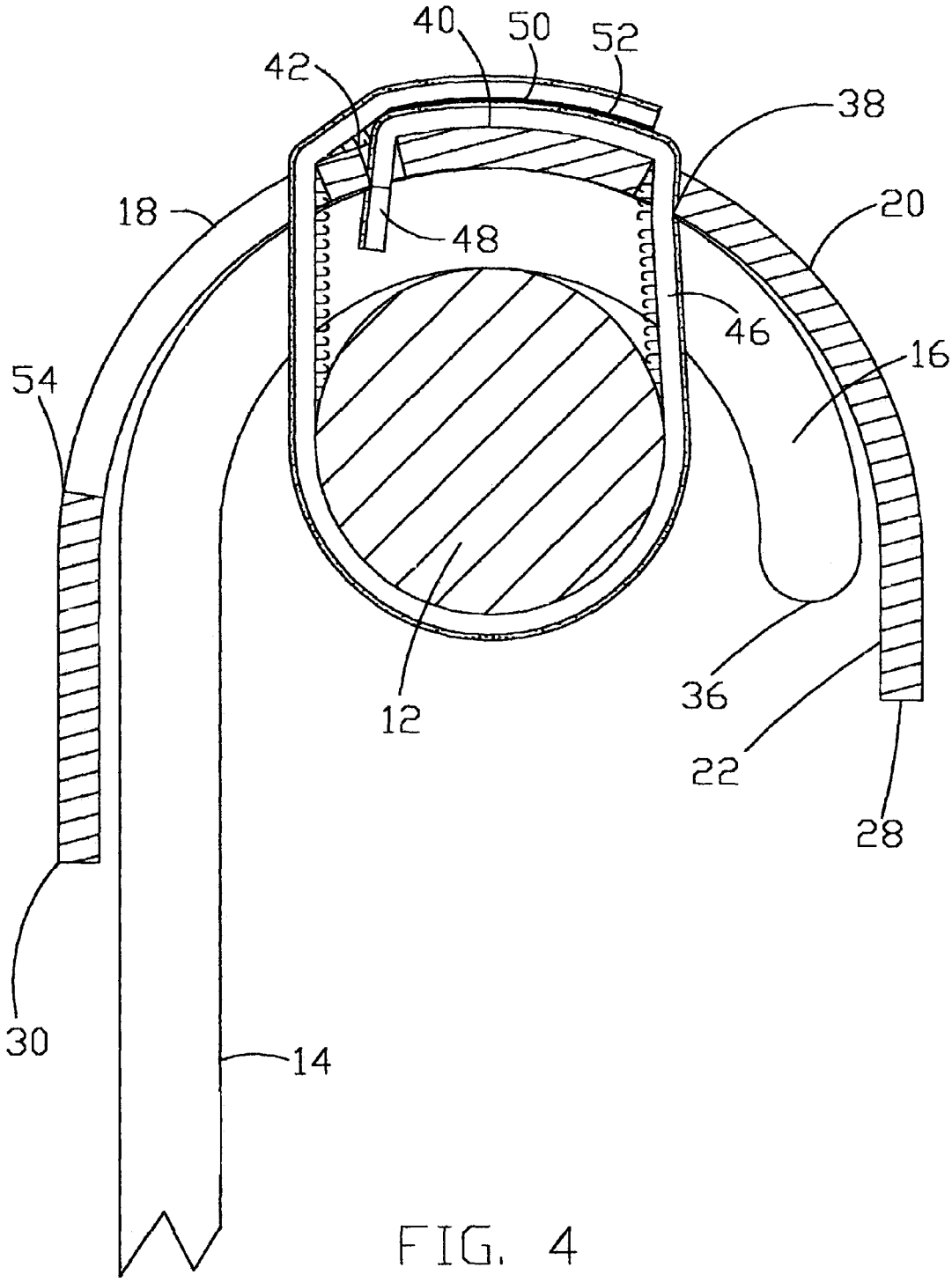
FIG. 4 is a sectional view of FIG. 1, depicting section 4—4.
Figure 5:
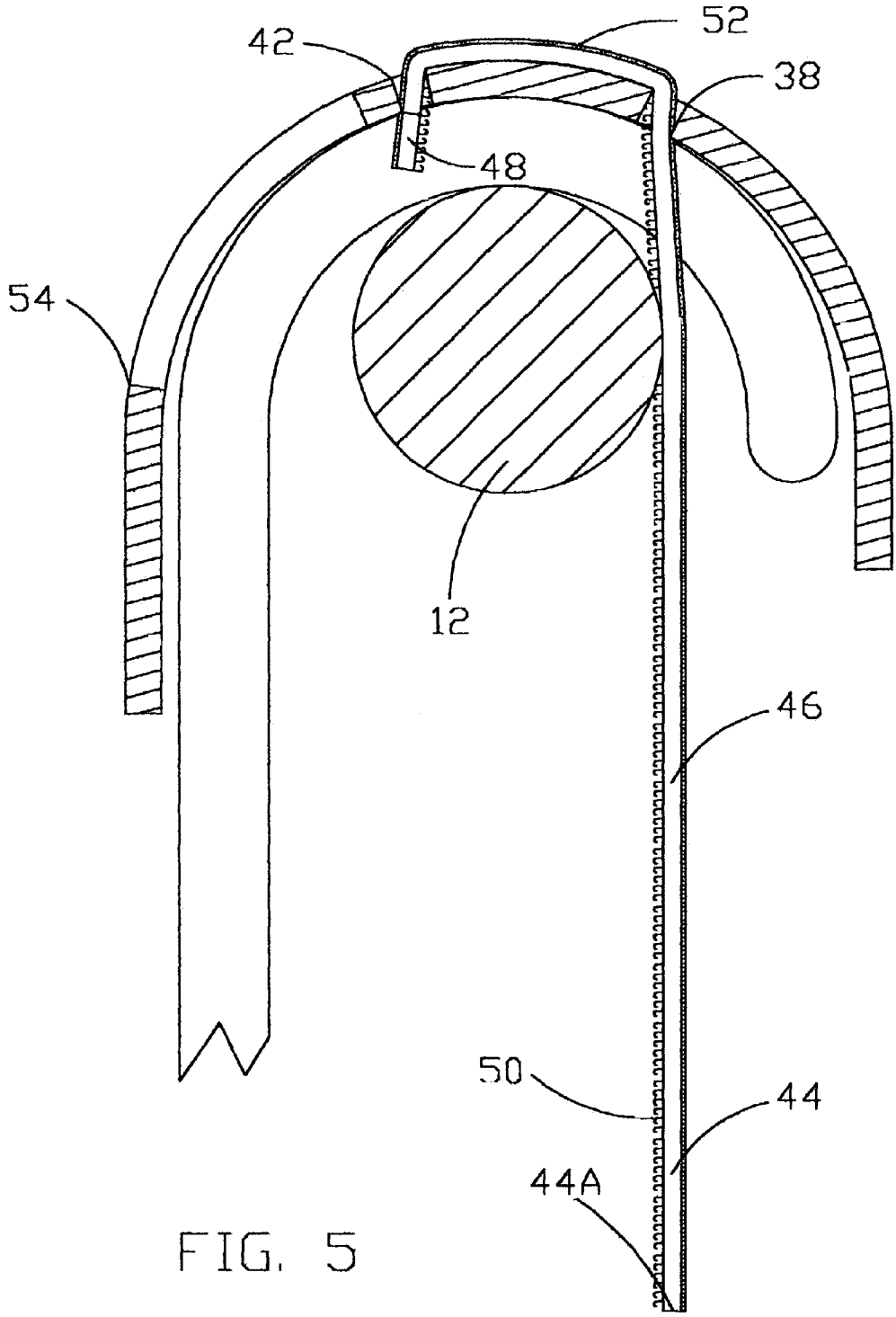
FIG. 5 is a modified view of FIG. 4, showing the clothes hanger retaining device in a released position.

A series of openings are provided in the cover 18 about midway between the first and second ends 24 and 26. As shown in FIGS. 4 and 5, the first opening 38 resides proximate an apex point 40 of the cover 18 draped over the clothes hangers 14 and the pole 12, but somewhat forward toward the front edge 28. A second opening 42 resides proximate the apex point 40 but somewhat back toward the back edge 30. The first and second openings 38 and 42 both have a longitudinal extent aligned with the pole 12 that is only slightly larger than the width of the web 44 of a securing strap 46. The openings 38 and 42 are also of a width only slightly larger than the thickness of a securing strap 46.

Figures 8A, 8B, 8C, 8D, 8E, 8F:
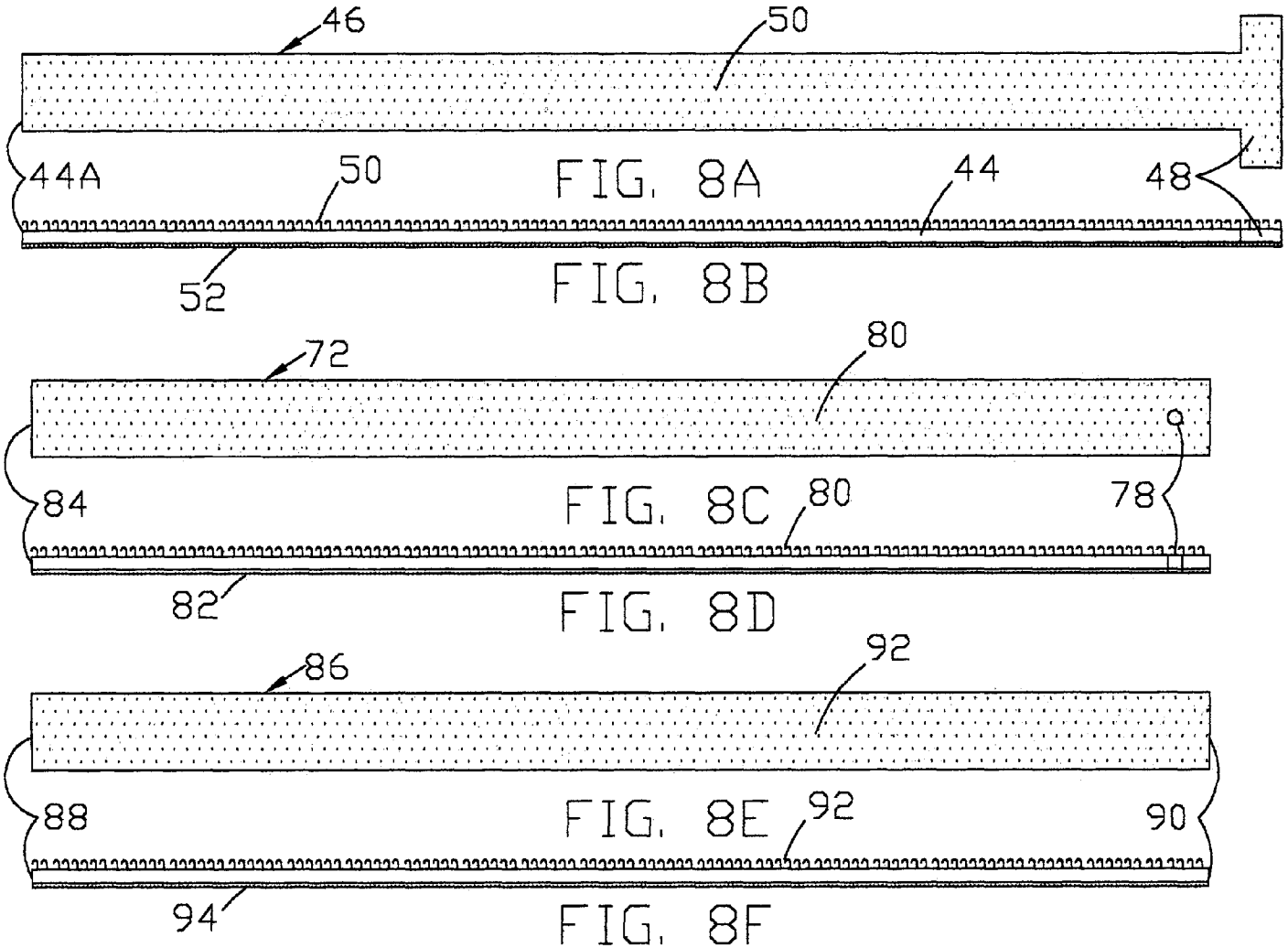
FIG. 8 shows top and side views of three embodiments of hook and loop strap.

As shown in FIGS. 8A and 8B, the strap 46 comprises the elongate web 44 connected to a T-shaped head 48. One side of the Web is laminated with hook material 50 of a hook and loop type faster, while the other side of the web is laminated with loop material 52 of hook and loop type fastener. A suitable hook and loop type fastener is commercially available under the trade name Velcro®.

A third opening 54 is disposed between the second opening 42 and the back edge 30. The third opening 54 is only slightly wider than the width of the web 44 of the strap 46. However, while the first and second openings 38 and 42 are dimensioned to have a somewhat larger width perpendicular to the longitudinal axis of the cover 18, that is not the case with the third opening 54. Instead, the third opening 54 has a substantial extent perpendicular to the longitudinal axis of the cover 18.

In use, the cover 18 is draped over the neck 16 of the hangers 14. In the drawings, the front edge 28 is shown adjacent to the terminus 36 of the hangers and the back edge 30 is adjacent to the hanger shoulder portion (not shown). However, this positioning is reversible. Nonetheless, the distal end of the strap web 44 is moved through the second opening 42 until the T-shaped head 48 contacts the lower side 22 of the cover 18. The distal end 44A of the strap web 44 is then moved through the first opening 38 so that the strap hangs freely (FIG. 5). In this position, the loop surface 52 of the hook and loop type fastener faces upwardly. The distal end 44A of the web 44 is then moved up through the third opening 54 and brought around so that the hook portion 50 of the hook and loop type fastener engages with loop surface 52. The strap 46 now substantially encircles the pole 12, thereby securing the cover 18 over the neck 16 of the hangers 14 (FIG. 4). The hangers 14 are trapped between the cover 18 and the pole 12 held in place by the encircling strap 46.

Figure 6:
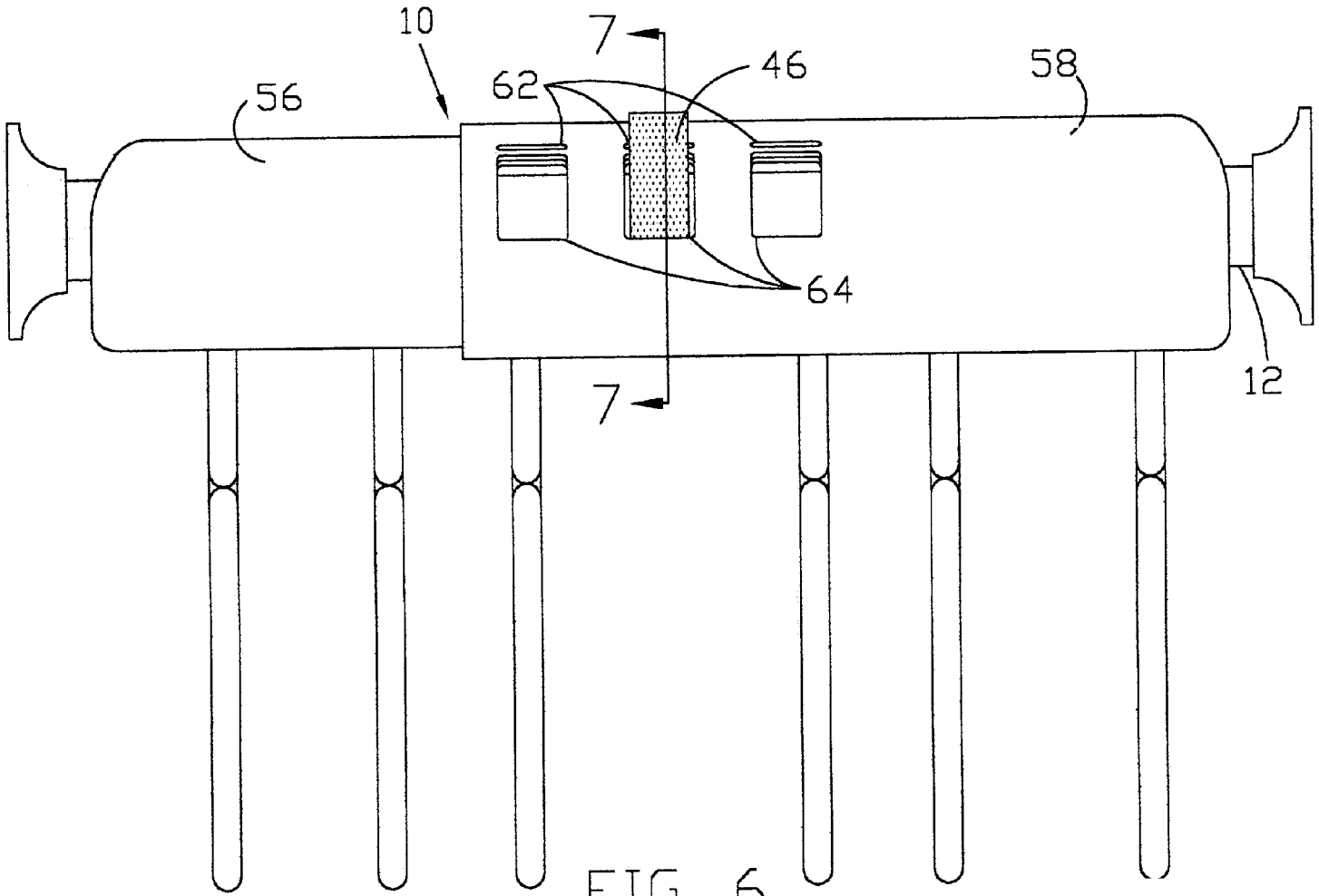
FIG. 6 is a front view of a second embodiment of the invention, showing a telescopically adjustable cover.
Figure 7:
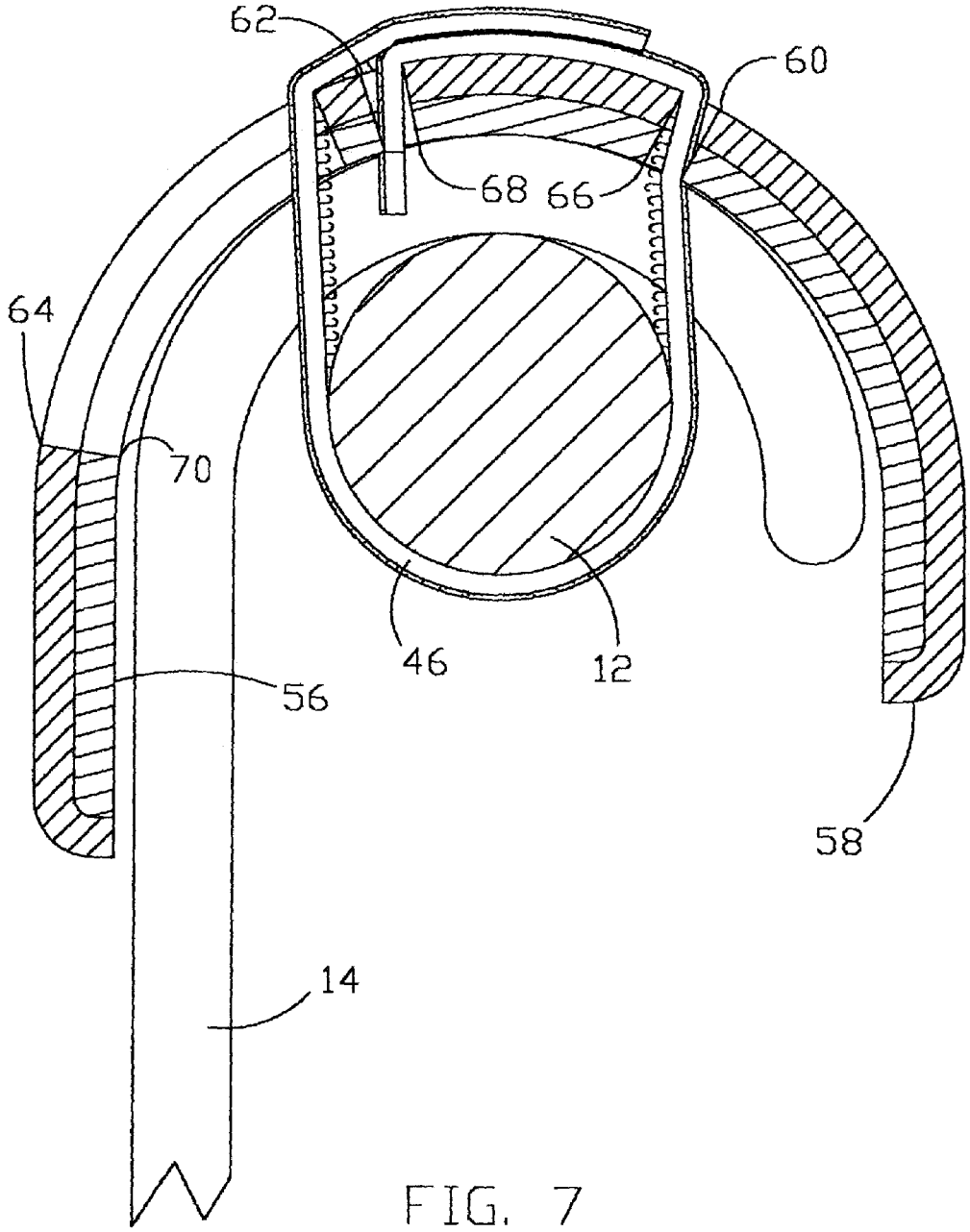
FIG. 7 is a sectional view of FIG. 6, depicting section 7—7.

FIGS. 6 and 7 show a second embodiment of the device, which is adjustable in length. The cover is composed of two telescopically engaged sections 56 and 58. The outer section 58 has a series of openings 60, 62 and 64, while the inner section 56 has a series of openings 66, 68 and 70, all of which are parallel to the axis of the clothes pole 12. The openings in the respective cover sections, 56 and 58 are dimensioned to align with each other radially, facilitating the insertion of the strap 46 as shown in FIG. 7.

In use, the strap is removed from the device. The cover sections 56 and 58 are then slid relative to each other to align the openings in both sections with one another, achieving the desired length. The strap 46 is then inserted through the aligned openings in sections 56 and 58, as previously described, thereby holding in place the length adjustment. After the length adjustment desired is complete, the device is then used as previously described.

Figure 9:
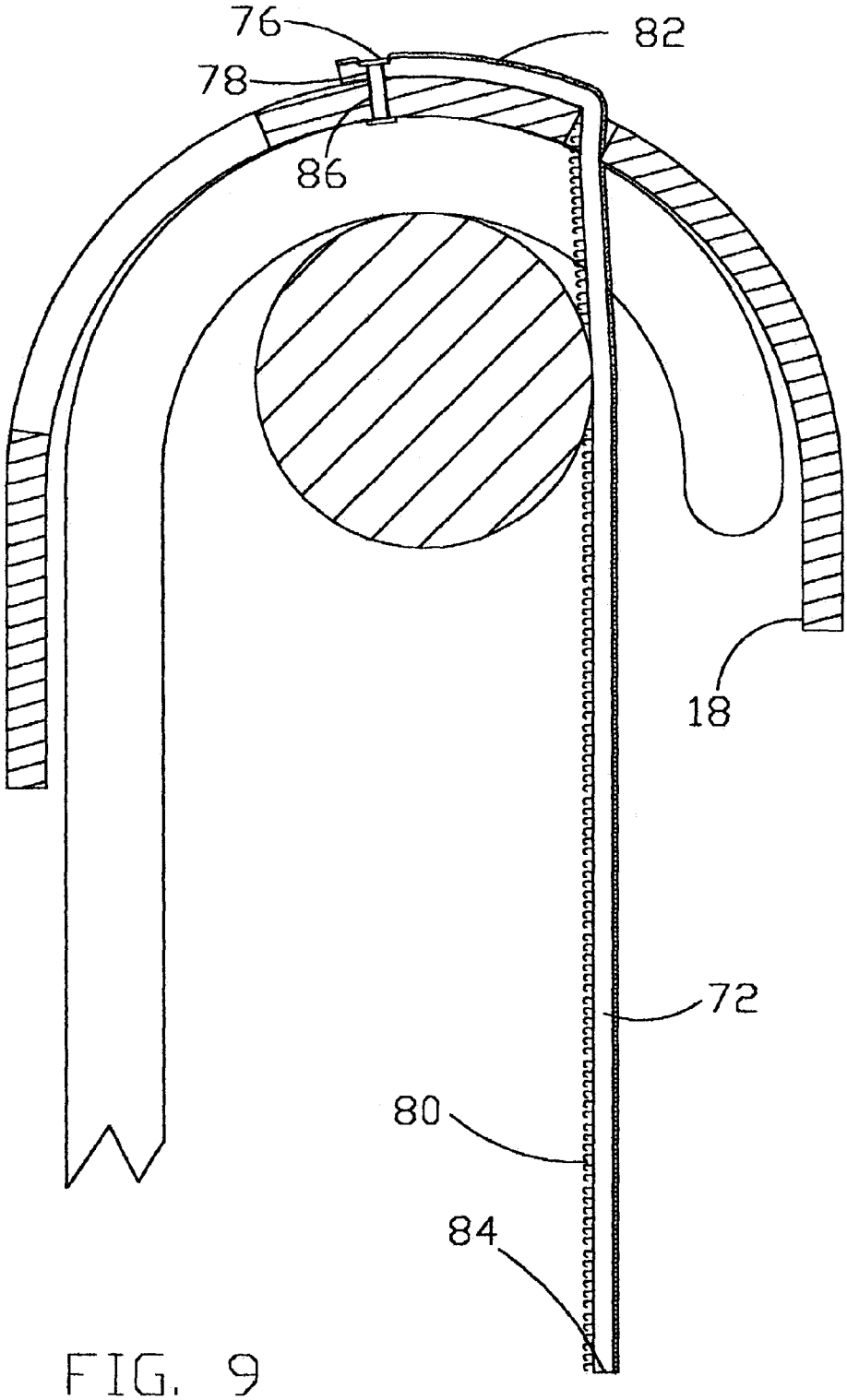
FIG. 9 is a sectional view of a third embodiment of the invention.

FIG. 9 shows a third embodiment of the device, wherein the strap 72 (FIGS. 8C and 8D) is fastened to the cover 18 by a rivet 76 through a hole 78 in the strap 72, and a hole 86 in the cover 18. In this embodiment, the second opening 42 in the cover 18 shown in the first embodiment is eliminated. The T-shaped head 48 of the strap 46 shown in the first embodiment is also eliminated. It is also contemplated in this third embodiment that the strap 72 may be alternately attached to the cover 18 by adhesive, sewing, a button, a snap, or by plastic fusion means.

In use, this third embodiment functions the same as in the first embodiment.

Figure 10:
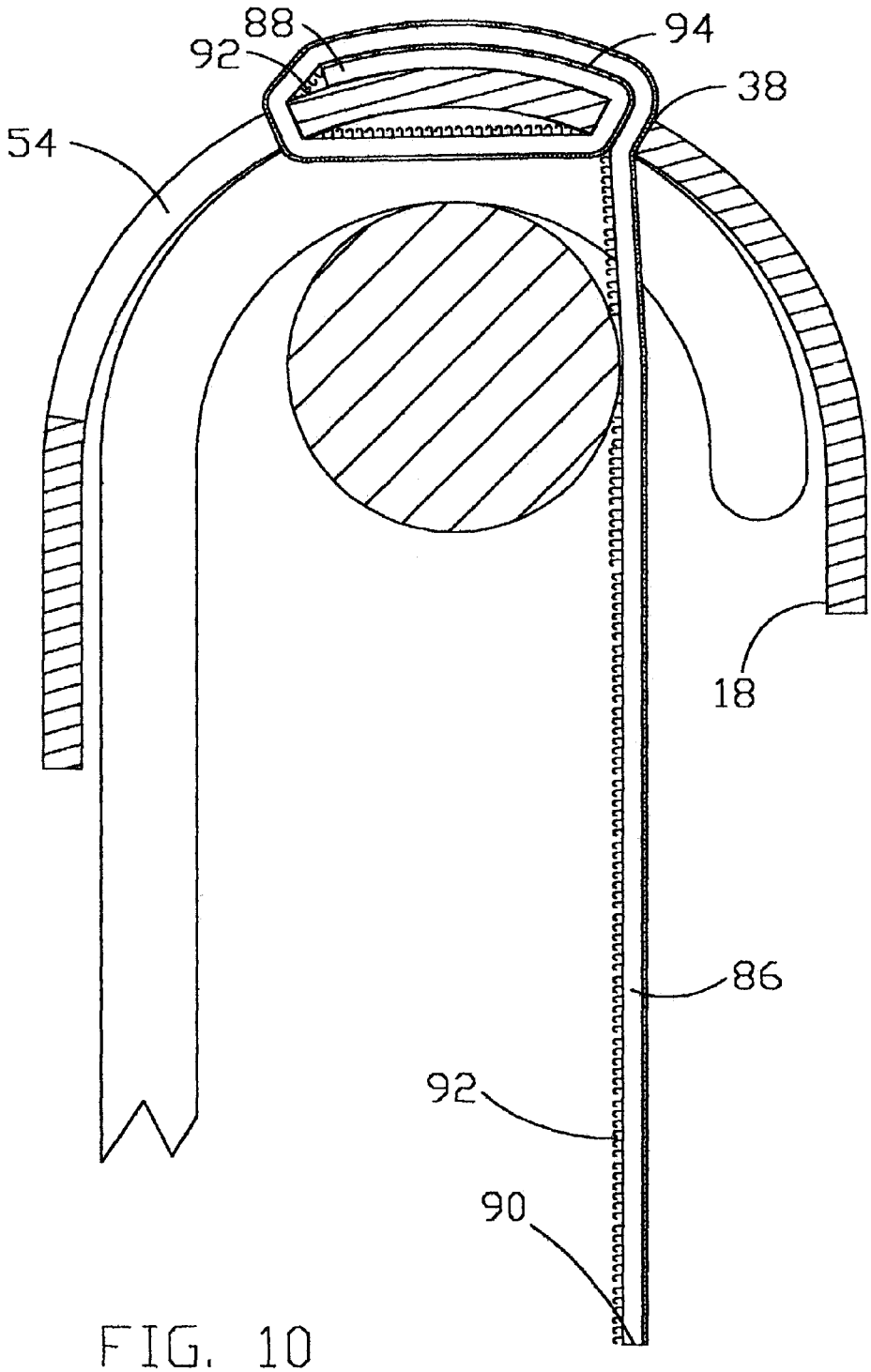
FIG. 10 is a sectional view of a fourth embodiment of the invention.

FIG. 10 shows a fourth embodiment of the device, wherein the strap 86 (FIGS. 8E and 8F) is fastened to the cover 18 by looping through openings in the cover and then engaging to itself in this embodiment, the second opening 42 in the cover 18 shown in the first embodiment is eliminated. The T-shaped head 48 of the strap 46 shown in the first embodiment is also eliminated. In this embodiment the first end of the strap 88 is positioned on the outside of the cover 18 adjacent to the third opening 54, between the first opening 38 and third opening 54. The second end 90 of the strap 86 is then inserted through the first opening 38 of the cover 18, looped around the inside portion of the cover between the first opening 38 and third opening 54, and inserted through the third opening 54. The hook side 92 of the strap 86 is then engaged to the loop side 94 of the strap at the first end 88 of the strap. The second end 90 is then inserted through the first opening 38 again and drawn taught, thus engaging the strap to itself from the first end of the strap 88 to the inside portion of the cover 18 at the first opening 38. In this embodiment, the width of the first opening 38 must allow both sections of the strap to be inserted through it.

In use, this fourth embodiment functions the same as in the first embodiment.

CONCLUSION, RAMIFICATIONS AND SCOPE

This invention provides a simple method for retaining clothes hangers to clothes poles. In addition, this invention is adaptable to existing clothes poles and hangers. While the description above contains many details, these should not be construed as limiting the scope of the invention, but as a preferred embodiment of the invention.

Many variations are possible. For example, the shape of the cover could be changed to any configuration that would adequately restrict the movement of the clothes hangers when the device is installed. Multiple straps could also be used to secure long sections of covers. Various methods could also be used to attach the strap to the cover, or the strap to the clothes pole. Accordingly, the scope of the invention should be determined by the claims, not the specifics of the preferred embodiment.

I claim:

1. A clothes hanger retaining device for retaining at least one clothes hanger on a clothes pole, the clothes hanger retaining device comprising:

a cover comprising an upper side and a lower side extending to spaced apart first and second ends and front and back edges, wherein with the cover adapted to be draped over a hook portion of the clothes hanger supported on the clothes pole, the first and second cover ends are adapted to be adjacent to spaced apart ends of the clothes pole, the front cover edge is adapted to be adjacent to a terminus of the hanger hook portion, and the back cover edge is adapted to be adjacent to where the hanger hook portion attaches to a shoulder portion of the hanger;

b) a first opening in the cover located between the first and second ends thereof and spaced toward the front cover edge from an apex of the cover;

c) a second opening in the cover aligned along a substantially horizontal plane, with the first opening between the first and second ends, but spaced toward the back edge from the apex; and d) a strap extending through the first opening and of a length to extend lower side of the cover and through the second opening so as to be also adapted to extend about the clothes pole, wherein with a distal end of the strap extending through the second opening, an inner surface of the distal strap end comprises one of a hook and loop of a hook-and-loop type fastener and an outer surface of a proximal end of the strap residing on the upper surface of the cover comprises the other of the hook and loop to thereby secure the distal end of the strap to the proximal end thereof, thereby allowing the hook portion of the clothes hanger to be sandwiched between the cover and the clothes pole.

2. A clothes hanger retaining device according to claim 1, wherein the distal end of the strap is of substantially a uniform width with the proximal end being wider than the first opening to secure the strap to the cover.

3. A clothes hanger retaining device according to claim 1, wherein the first and second cover ends are provided with respective flanges that extend inwardly.

* * * * *